US008590821B2

(12) United States Patent
Schwamborn et al.

(10) Patent No.: US 8,590,821 B2
(45) Date of Patent: Nov. 26, 2013

(54) PENDULUM MILL

(75) Inventors: Karl-Heinz Schwamborn, Bonn (DE); Jurgen Vienken, Selfkant (DE); Joachim Galk, Gangelt-Birgden (DE); Günter Plihal, Jülich (DE); Werner Teriete, Aachen (DE); Toni Simons, Ubach-Palenberg (DE); Norbert Bianga, Much (DE)

(73) Assignee: Neuman & Esser GmbH Mahl—und Sichtsysteme, Ubach-Palenberg (DE)

( * ) Notice: Subject to any disclaimer, the term of this patent is extended or adjusted under 35 U.S.C. 154(b) by 274 days.

(21) Appl. No.: 13/138,264

(22) PCT Filed: Jan. 26, 2010

(86) PCT No.: PCT/EP2010/050847

§ 371 (c)(1),
(2), (4) Date: Jul. 26, 2011

(87) PCT Pub. No.: WO2010/086298

PCT Pub. Date: Aug. 5, 2010

(65) Prior Publication Data

US 2011/0278386 A1 Nov. 17, 2011

(30) Foreign Application Priority Data

Jan. 27, 2009 (DE) ..... 10 2009 000 442

(51) Int. Cl.
*B02C 4/10* (2006.01)

(52) U.S. Cl.
USPC ..... 241/129; 241/131

(58) Field of Classification Search
USPC ..... 241/110, 123–133
See application file for complete search history.

(56) References Cited

U.S. PATENT DOCUMENTS 5,975,448 A 11/1999 Gygi

FOREIGN PATENT DOCUMENTS

| | | | |
|---|---|---|---|
| DE | 417260 | A | 8/1925 |
| DE | 3301166 | A1 | 7/1984 |
| DE | 3409710 | A1 | 9/1984 |
| DE | 290316 | C4 | 3/1992 |
| DE | 4118657 | A1 | 12/1992 |
| DE | 9308643.1 | U1 | 9/1993 |
| DE | 69700025 | T2 | 9/1998 |
| EP | 0658379 | A1 | 6/1995 |
| FR | 141924 | A | 10/1965 |

*Primary Examiner* — Mark Rosenbaum
(74) *Attorney, Agent, or Firm* — Hudak, Shunk & Farine Co. LPA

(57) ABSTRACT

A pendulum mill is described that comprises a mill housing, inside which a drive shaft is arranged. Milling pendulums are suspended at the upper end of the drive shaft, while a driving device which is suspended on the bottom wall of the mill housing is disposed at the lower end of the drive shaft.

20 Claims, 4 Drawing Sheets

PENDULUM MILL

FIELD OF THE INVENTION

The invention concerns a pendulum mill with a mill housing, in which a drive shaft is disposed, from whose upper end are suspended milling pendulums, and with a drive mechanism connected to the lower end of the drive shaft.

BACKGROUND OF THE INVENTION

A pendulum mill is known from DE-PS 33 01 166, having a mill housing, which is connected to the necessary feeding and discharging devices for the material being milled. The mill housing comprises a lower and an upper mill housing, the lower mill housing having an annular grinding track on the inside of its circumferential wall.

In the mill housing there is arranged vertically a driving column, at the upper end of which is secured a stationary crosshead, from which several milling pendulums are suspended to form the milling implements. The milling rollers of the milling pendulums are forced against the grinding track by centrifugal force as the driving column rotates.

At the lower end of the driving column is arranged a transmission and to the side of the transmission a drive motor. Both the lower mill housing and the drive motor are fastened to the floor of the building.

When the pendulum mill is in operation, vibrations are created in various regions of the pendulum mill both by the drive motor and the transmission unit and by the milling implements, which not only produce a correspondingly high noise level, but also in particular lead to a substantial stress on the material of the pendulum mill and thus increased wear on the structural parts of the pendulum mill.

A sifter housing with a flap-type air sifter is arranged on the mill housing according to DE-PS 33 01 166. Such pendulum mills have been in use for many years and are reliable in operation.

Even so, the milling implements and the drive motor, as well as coupling and transmission, are in need of maintenance and may also have to be repaired once wear occurs, which may lead to long down time, because access to the particular structural parts of the pendulum mill in the current designs is only possible after time-consuming dismantling and reconstruction work.

SUMMARY OF THE INVENTION

The problem of the invention is to indicate a pendulum mill in which both the noise production and the material stress caused by vibrations are reduced.

This problem is solved with a pendulum mill in which the driving mechanism is arranged to hang free from the bottom wall of the mill housing.

The drive mechanism is preferably arranged underneath the bottom wall.

It has been found that, when the drive mechanism is fastened to the floor of the building on which the mill housing is also arranged, the drive train forms its own oscillatory system, which generally behaves asynchronously to the oscillatory system of the mill housing and the revolving milling implements located therein, which leads overall to increased material stress for the structural parts of the pendulum mill. Especially when the two oscillatory systems produce vibrations working in opposite direction, this leads to increased wear on the structural parts.

Compared to this, the free-hanging arrangement of the drive mechanism from the bottom wall of the mill housing has the advantage that the drive mechanism has no connection to the floor of the building or the foundation on which the mill housing sits. This decoupling means that the drive mechanism and the mill housing form a common oscillatory system, which accordingly produces combined vibrations that are much more sparing to the materials.

No asynchronous or oppositely-acting oscillations can occur, so that the material of the components of the pendulum mill are spared and at the same time the noise output is reduced.

The pendulum mill is preferably a transmission-free pendulum mill. Eliminating the transmission saves space, so that in particular the height of the layout can be decreased. When the transmission is arranged under the mill housing on the foundation—as is generally the case—eliminating the transmission can also reduce the width of the layout there.

Preferably, the drive mechanism is a direct drive. Such a direct drive is characterized by a continuous speed control and has neither a coupling nor a transmission. The advantage of a direct drive is thus that its configuration is both compact and also essentially rotationally symmetrical to the output shaft. The direct drive is low in vibration during operation and therefore in addition to the oscillatory decoupling by the free-hanging arrangement it also helps lower the strain on the structural parts of the pendulum mill.

Other benefits of a direct drive are that it is maintenance-friendly, because no transmission oil is needed, which has to be replenished from time to time. Moreover, there is no transmission and no motor coupling, which would require maintenance. The energy consumption of a direct drive is much lower than that of traditional drive mechanisms, such as those provided in DE-PS 33 01 166, for example.

Preferred direct drives are a hydraulic motor or a torque motor, for example.

In hydraulic motors, also known as hydromotors, hydraulic energy is transformed into mechanical work. There are many designs of hydraulic motors, which can be subdivided according to their mode of operation into basically constant and variable motors. Variable motors are preferred for use in a pendulum mill, in order to adjust the circumferential velocity of the milling implements. The torque produced by hydrodynamic motors can be controlled independently of the rotational speed. The maximum torque of a hydraulic motor is determined by the pressure of the hydraulic fluid. The so-called absorption volume determines the rotational speed, which depends on the supplied volume flow.

Especially preferred are torque motors, because these are electrically operated and require no intake or discharge lines for the hydraulic fluid, as compared to hydraulic motors. Torque motors only require a cooling water circuit. A torque motor is a multipole electric motor with very high torque and relatively low rotational speed.

Preferably, the torque motor is installed vertically, so that the output shaft of the torque motor is oriented vertically.

Preferably, the direct drive has an output shaft that is connected to the drive shaft.

It is especially preferred that the direct drive have an output shaft that is identical to the drive shaft of the pendulum mill. This configuration has the advantage of being even more compact and requiring no additional connections between output shaft and drive shaft in terms of assembly.

Preferably, the drive shaft, especially when the shaft is formed as a single piece, is mounted in a bearing solely in the direct drive. This configuration has the advantage of not needing any bearing locations on the mill housing, for example, for the mounting of the direct drive and the drive shaft, which further simplifies the overall arrangement of the components of the pendulum mill.

It is furthermore preferred to fasten the drive mechanism to a mounting plate, especially in detachable manner. The fastening to the mounting plate can be direct or indirect.

Advantageously, the mounting plate is detachably connected to the bottom wall of the mill housing. The drive mechanism with shaft and possibly with the milling implements can be prefabricated together with the mounting plate and be installed in the housing of the pendulum mill in simple manner as a finished structural unit, preferably from above.

Preferably, the mounting plate is part of the bottom wall of the mill housing. For this, the bottom wall of the mill housing preferably has a cut-out in which the mounting plate can be installed.

The mounting plate can preferably be removed from above. For this purpose, the bottom wall has a bearing surface for the mounting plate preferably on its inside at the edge of the cut-out, such as a recess to accommodate the mounting plate or an annular flange. The removal of the mounting plate from above has the advantage that the drive mechanism with its accompanying shaft can be lifted out at the top. No dismantling of drive mechanism and shaft underneath the bottom wall of the mill housing is necessary, so that no correspondingly larger machine space needs to be provided. In this way, the pendulum mill has a compact layout.

The bottom wall of the mill housing preferably has at least one locking mechanism, which in the locked position secures the mounting plate. For this, the mounting plate has corresponding means that interact with the locking mechanism of the bottom wall.

The locking mechanism preferably has at least one locking bolt that can move preferably in the horizontal direction.

Moreover, the locking mechanism can have an activating mechanism, which makes it possible to achieve or facilitate the installation and removal of the drive mechanism with drive shaft and milling implements as a structural unit.

Preferably, a paddle disk is connected to the drive shaft in rotationally fixed manner above the mounting plate. The paddle disk can also be premounted before the installation of the drive mechanism. In this configuration, the replaceable structural unit comprises the drive mechanism, the mounting plate, the drive shaft with the milling implements and the paddle disk.

Preferably, the mill housing is arranged on a vibration foundation. This accomplishes a further dampening of vibrations, while the drive mechanism has no direct connection to this vibration foundation.

To reduce the structural height of the pendulum mill, it is preferred that the vibration foundation has a reception chamber in which the drive mechanism protrudes in free hanging manner.

BRIEF DESCRIPTION OF THE DRAWINGS

Sample embodiments will be explained more closely below by means of the drawings.

There are shown.

DETAILED DESCRIPTION OF THE INVENTION

Figure 1:
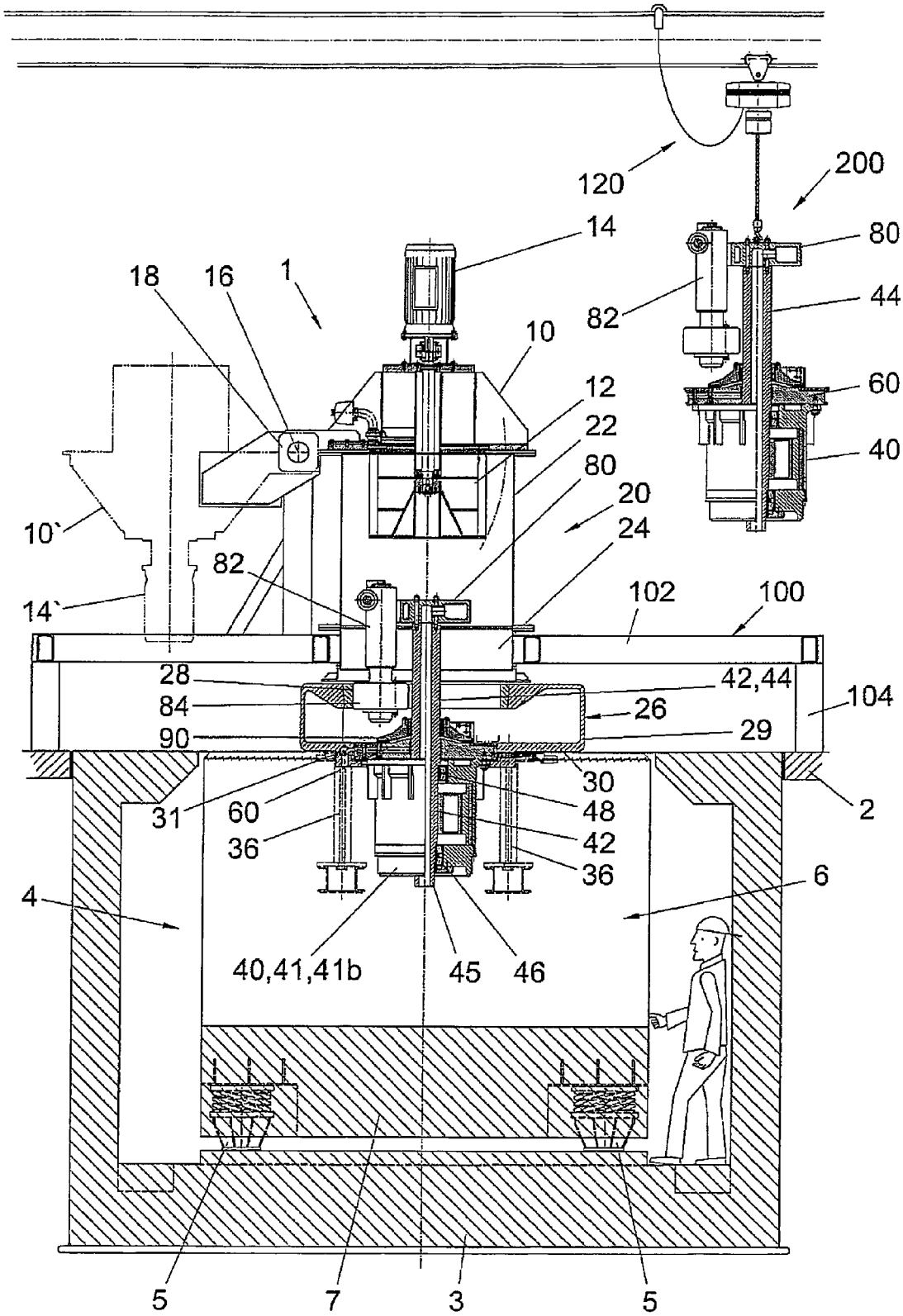
FIG. 1, a vertical section through a pendulum mill, including the vibration foundation, FIG. 2, an enlarged representation of the lower mill housing with mounting plate and drive mechanism fastened to it, FIG. 3, another embodiment with a torque motor flanged on, and FIG. 4, an embodiment with a hydraulic motor.

FIG. 1 shows a pendulum mill 1, having a mill housing 20 consisting of an upper mill housing 22 and a lower mill housing 26, with an intermediate ring 24 arranged between the upper and the lower mill housing. On the upper mill housing 22 is disposed a sifter housing 10, which contains a sifter 12, which protrudes into the inner space of the upper mill housing 22. The sifter 12 is driven by its own sifter drive 14, which is disposed on the sifter housing 10.

In the mill housing 20 there is vertically disposed a drive shaft 44, having a stationary crosshead 80 at its upper end, from which several milling pendulums 82 are suspended. Only one such milling pendulum 82 can be seen in FIG. 1, having a milling roller 84 at its lower end. The lower mill housing 26 has a grinding track 28 on the inside of its circumferential wall 29, against which the milling rollers 84 are pressed by the centrifugal force when the drive shaft 44 is rotating. The material being milled is comminuted between the grinding track 28 and the milling rollers 84.

The drive shaft 44 is configured as a hollow shaft and extends downward from the lower mill housing. At the lower end is disposed a drive mechanism 40, which is configured as a direct drive 41. In the embodiment shown in FIG. 1, the direct drive 41 is a torque motor 41*b*. The electrical power lines and the cooling water lines for this torque motor 41*b* are not shown in FIG. 1.

Moreover, FIG. 1 shows an embodiment in which the output shaft 42 of the torque motor 41*b* is identical to the drive shaft 44 of the pendulum mill 1. Furthermore, one can see that this common shaft 44 is mounted solely by bearing points 46 and 48 in the direct drive. No additional bearing points are needed on the mill housing 20.

The drive mechanism 40 is fastened to a mounting plate 60, which is fastened in a circular cut-out 31 of the bottom wall 30 of the lower mill housing 26. Details as to the fastening of the mounting plate 60 in the bottom wall 30 of the lower mill housing 26 will be described in connection with FIG. 2.

A paddle disk 90 is shown above the mounting plate 60.

The diameter of the mounting plate 60 is larger than the outer diameter of the drive mechanism 40, so that these are premounted together with the drive shaft 44 and the milling pendulums 82 and can be inserted from above into the mill housing 20 as a structural unit 200. The entire structural unit 200 is shown in the upper right part of FIG. 1.

The lower mill housing 26 is fastened by means of anchor bolts 36, shown by dotted lines, to a vibration foundation 4, having a base body 7 of concrete, for example. This base body 7 lies across vibration dampeners 5 on the foundation 3. Inside the vibration foundation 4 is formed a reception chamber 6, into which the drive mechanism 40 protrudes in free hanging manner. The drive mechanism 40 has no connection to the vibration foundation 4 or to the foundation 3.

The drive shaft 44 is configured as a hollow shaft, so that seal gas can be introduced at the lower end 45.

By means of the intermediate ring 24, which is arranged between the upper mill housing 22 and the lower mill housing 26, the mill housing 20 is connected to the floor of the building 2 by a load-bearing structure 100. This load-bearing structure 100 has transverse girders 102 and stanchions 104.

To remove the drive mechanism 40, the sifter housing 10 is designed to swivel about a horizontal axis 16, so that the sifter housing 10 can be moved into the dotted-line position by means of the swivel drive 18 (see reference numbers 10', 14').

In the next step, the upper mill housing 22 is swiveled open, so that the drive shaft 44 with the milling pendulums 82 mounted on it is accessible.

By means of a lifting device 120, engaging with the stationary crosshead 80, the entire structural unit 200 comprising the drive mechanism 40 can be removed from the bottom wall 30 of the lower mill housing 26, after loosening the mounting plate 60.

Figure 2:
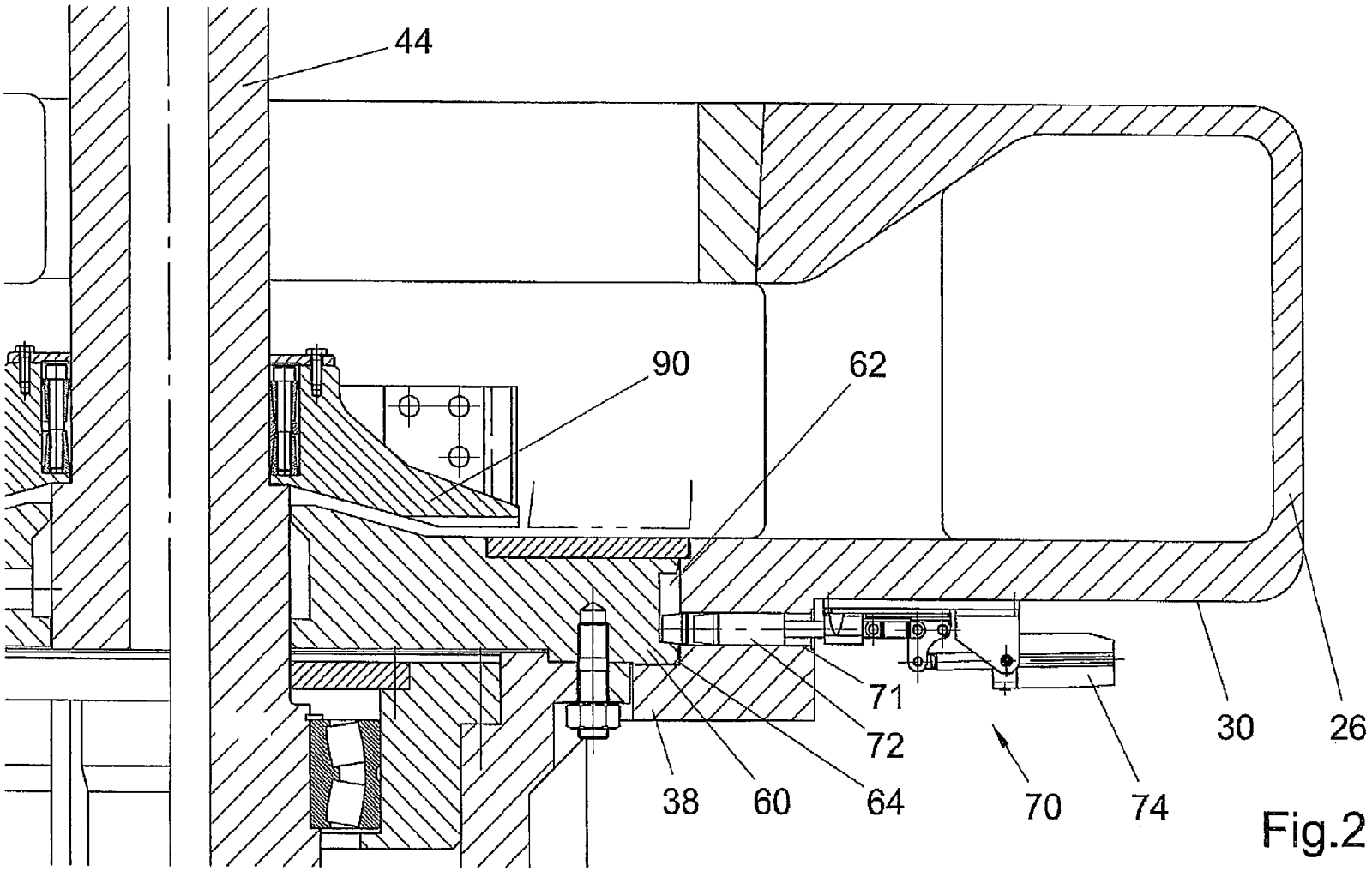

FIG. 2 shows an enlarged feature of the bottom region of the lower mill housing 26. The mounting plate 60, to the underside of which the drive mechanism 40 is attached by means of screws, has a diameter that is greater than or equal to the diameter of the cut-out 31 in the bottom wall 30 of the lower mill housing 26. For easier installation of the mounting plate, this has a bevel 64 at the lower edge.

The mounting plate 60 has a greater wall thickness than the bottom wall 30, so that the bottom plate 60 projects downward. The bottom wall 30 has an annular flange 38 in the area of accommodation of the mounting plate 60, on which the mounting plate 60 rests. The mounting plate 60 rests on the top side of the annular flange 38 and can be removed from above.

In this annular flange there is provided a borehole 71, in which a locking bolt 72 of a locking mechanism 70 can move in the horizontal direction. In the locking position, the locking bolt 72 engages in an edge recess 62 of the mounting plate 60.

Underneath the bottom wall 30 and near the annular flange 38 is shown an activating mechanism 74, which engages with the locking bolt 72. The activating mechanism 74 can be pneumatically activated, for example, so that the locking bolt 72 can be moved from its resting to its locking position and back automatically.

Figure 3:
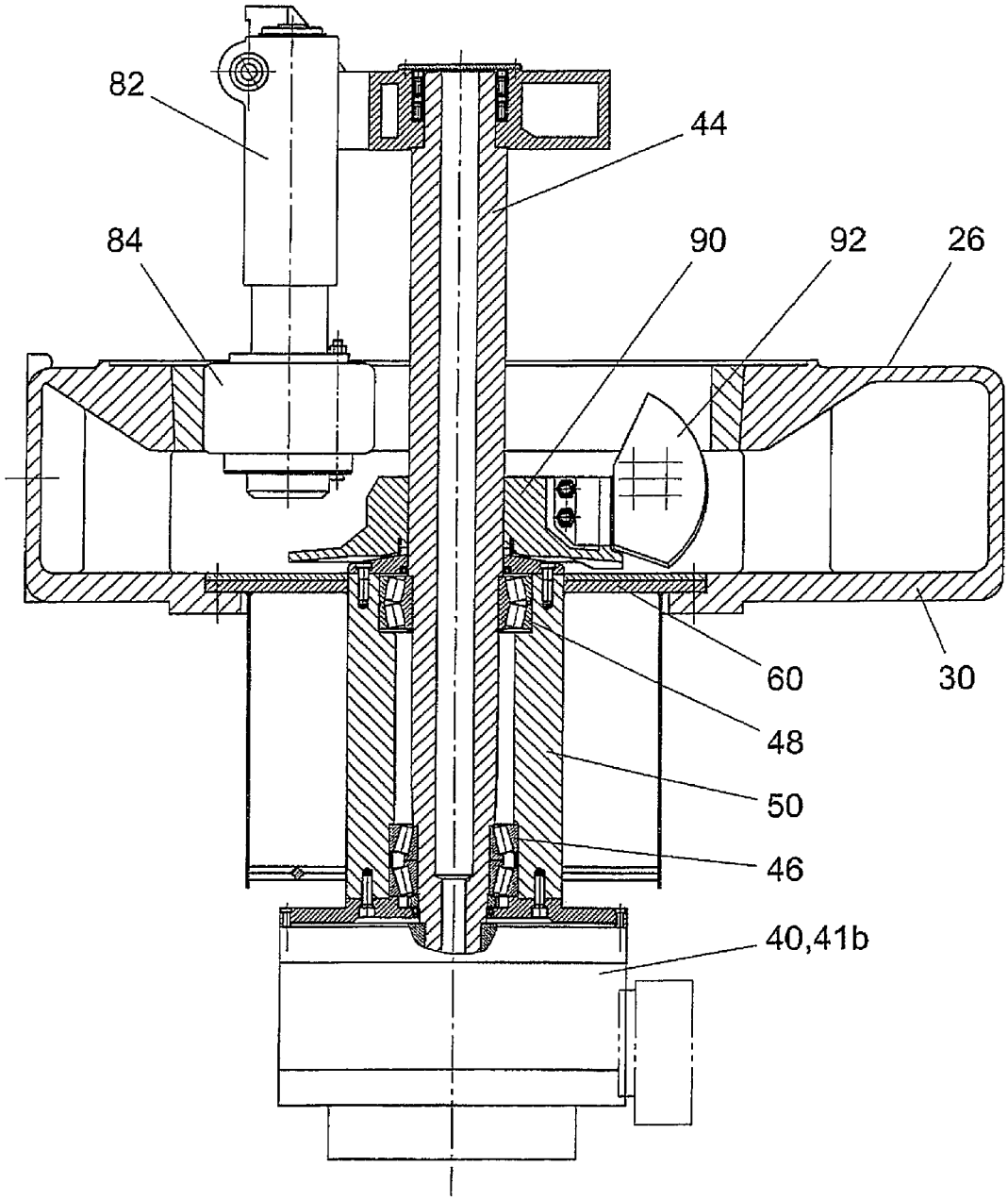

FIG. 3 shows an embodiment in which the drive mechanism 40 is a torque motor 41*b*, being fastened by a mounting ring 50 to the mounting plate 60.

Figure 4:
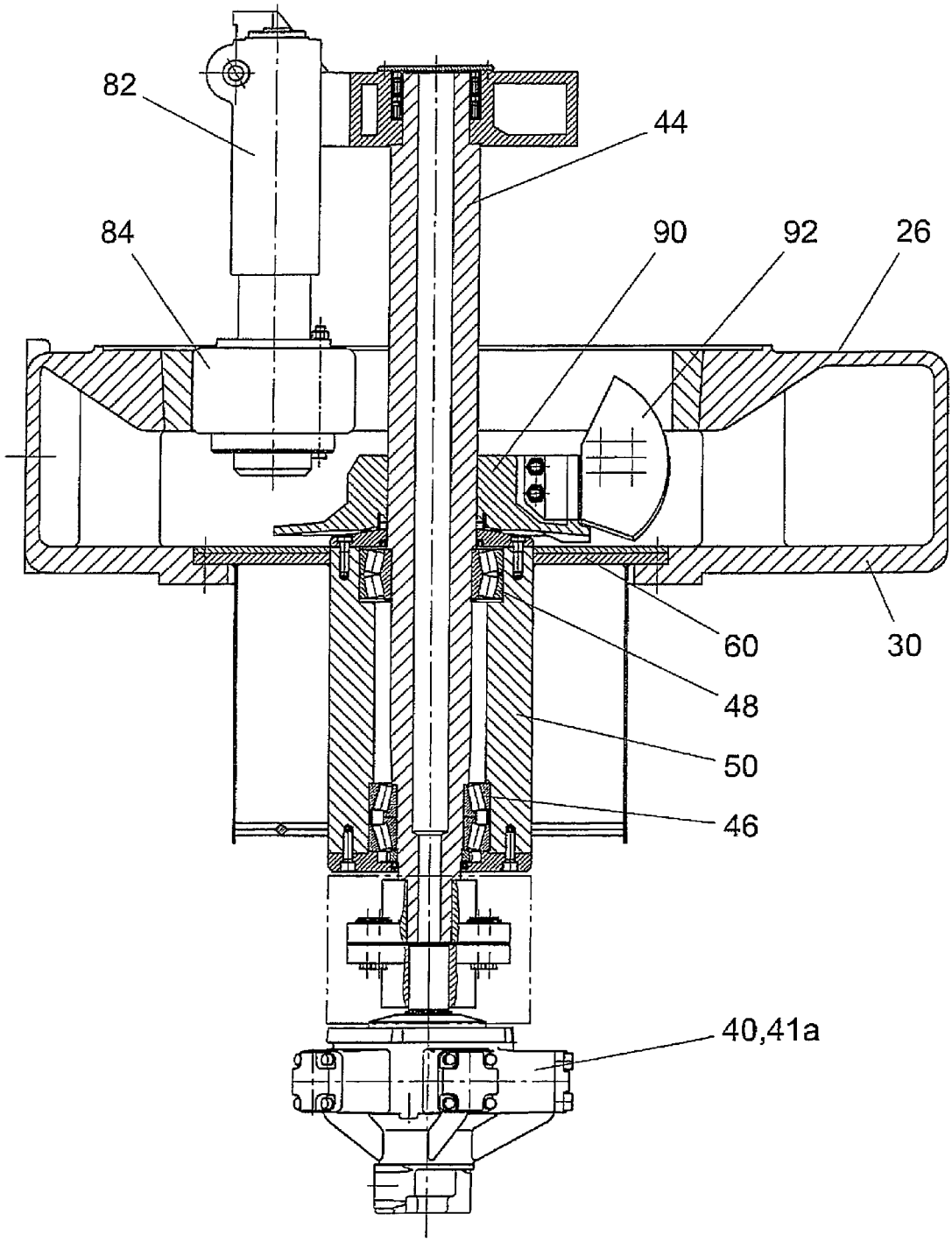

FIG. 4 shows another embodiment in which instead of a torque motor 41*b* there is provided a hydraulic motor 41*a* with a drive shaft 44. The feed lines for supplying the hydraulic motor with hydraulic fluid are not shown.

In addition, a paddle 92 is also shown on the paddle disk 90 in FIGS. 3 and 4.

LIST OF REFERENCE NUMBERS

1 pendulum mill
2 floor of the building
3 foundation
4 vibration foundation
5 vibration dampeners
6 reception chamber
7 base body
10, 10' sifter housing
12 sifter
14, 14' sifter drive
16 horizontal axis
18 swivel drive
20 mill housing
22 upper mill housing
24 intermediate ring
26 lower mill housing
28 grinding track
29 circumferential wall
30 bottom wall of the lower mill housing
31 cut-out
36 anchor bolts
38 annular flange
40 drive mechanism
41 direct drive
41*a* hydraulic motor
41*b* torque motor
42 output shaft
44 drive shaft
45 lower end of drive shaft
46 lower shaft bearing
48 upper shaft bearing
50 mounting ring
60 mounting plate
62 edge recess
64 bevel
70 locking mechanism
71 borehole
72 locking bolt
74 activating mechanism
80 stationary crosshead
82 milling pendulum
84 milling roller
90 paddle disk
92 paddle
100 load-bearing structure
102 transverse girders
104 stanchions
120 lifting gear
200 structural unit

What is claimed is:

1. A pendulum mill comprising: a mill housing, in which a drive shaft is disposed, from whose upper end are suspended milling pendulums, and with a drive mechanism connected to a lower end of the drive shaft, wherein the drive mechanism is disposed free hanging from a bottom wail of the mill housing.

2. The pendulum mill according to claim 1, wherein the drive mechanism is a direct drive.

3. The pendulum mill according to claim 2, wherein the direct drive is a hydraulic motor.

4. The pendulum mill according to claim 2, wherein the direct drive is a torque motor.

5. The pendulum mill according to claim 4, wherein the torque motor is installed vertically.

6. The pendulum mill according to claim 2, wherein the direct drive has an output shaft that is connected to the drive shaft.

7. The pendulum mill according to claim 2, wherein the direct drive has an output shaft that is identical to the drive shaft.

8. The pendulum mill according to claim 7, wherein the drive shaft is mounted in a bearing solely in the direct drive, wherein the drive mechanism is fastened to a mounting plate, wherein the mounting plate is detachably connected to the bottom wall of the mill housing, and wherein the mounting plate is part of the bottom wall of the mill housing.

9. The pendulum mill according to 8, wherein the diameter of the mounting plate is larger than an outer diameter of the drive mechanism, wherein the bottom wall of the mill housing has at least one locking mechanism, which in a locked position secures the mounting plate, wherein the locking mechanism has at least one locking bolt that can move in a horizontal direction, and wherein the at least one locking mechanism has an activating mechanism.

10. The pendulum mill according to claim 2, wherein the drive shaft is mounted in a bearing solely in the direct drive.

11. The pendulum mill according to claim 1, wherein the drive mechanism is fastened to a mounting plate.

12. The pendulum mill according to claim 11, wherein a paddle disk is connected to the drive shaft in rotationally fixed manner above the mounting plate.

13. The pendulum mill according to claim 11, wherein the mounting plate is detachably connected to the bottom wall of the mill housing.

14. The pendulum mill according to claim 13, wherein the mounting plate is part of the bottom wall of the mill housing.

15. The pendulum mill according to claim 13, wherein the diameter of the mounting plate is larger than an outer diameter of the drive mechanism.

16. The pendulum mill according to claim 1, wherein the bottom wall of the mill housing has at least one locking mechanism, which in a locked position secures the mounting plate.

17. The pendulum mill according to claim 16, wherein the at least one locking mechanism has at least one locking bolt that can move in a horizontal direction.

18. The pendulum mill according to claim 16, wherein the at least one locking mechanism has an activating mechanism.

19. The pendulum mill according to claim 1, wherein the mill housing is arranged on a vibration foundation.

20. The pendulum mill according to claim 19, wherein the vibration foundation has a reception chamber in which the drive mechanism protrudes in free hanging manner.

* * * * *

UNITED STATES PATENT AND TRADEMARK OFFICE

CERTIFICATE OF CORRECTION

PATENT NO. : 8,590,821 B2
APPLICATION NO. : 13/138264
DATED : November 26, 2013
INVENTOR(S) : Karl-Heinz Schwamborn et al.

It is certified that error appears in the above-identified patent and that said Letters Patent is hereby corrected as shown below:

In the Claims

Column 6, claim 1, line 35, replace “wail” with --wall--

Signed and Sealed this
Fourth Day of February, 2014

Michelle K. Lee

Michelle K. Lee
*Deputy Director of the United States Patent and Trademark Office*